United States Patent [19]

Usui et al.

[11] Patent Number: 4,527,178

[45] Date of Patent: Jul. 2, 1985

[54] HEAT-SENSITIVE RECORDING PAPER AND FILLER THEREFOR

[75] Inventors: Koichi Usui; Teiji Sato; Masanori Tanaka, all of Shibata, Japan

[73] Assignee: Mizusawa Industrial Chemicals, Ltd., Osaka, Japan

[21] Appl. No.: 572,999

[22] Filed: Jan. 23, 1984

[30] Foreign Application Priority Data

Jan. 21, 1983 [JP] Japan ..... 58-7276

[51] Int. Cl.[3] ..... B41M 5/18

[52] U.S. Cl. ..... 346/207; 346/208; 346/209; 427/150; 427/151; 428/328; 428/330; 428/331

[58] Field of Search ..... 346/200, 207, 208, 209, 346/225; 427/150, 151; 428/328, 330, 331

[56] References Cited

FOREIGN PATENT DOCUMENTS 0051846 5/1982 European Pat. Off. ..... 346/207

31794 2/1983 Japan ..... 346/207

*Primary Examiner*—Bruce H. Hess

*Attorney, Agent, or Firm*—Sherman & Shalloway

[57] ABSTRACT

Disclosed is a filler for a heat-sensitive recording paper, which comprises an amorphous silicate having a composition represented by the following oxide molecular ratio:

$$MO:SiO_2=0.01:1 \text{ to } 1.1:1$$

wherein M stands for at least one member selected from the group consisting of calcium, barium and zinc, or a product obtained by partially neutralizing said silicate with carbonic acid, said filler having a BET specific surface area of 10 to 70 $m^2/g$ and a bulk density of 0.14 to 0.30 g/cc and also having such a secondary particle size distribution that secondary particles having a size smaller than 4 $\mu$m, as determined by the centrifugal precipitation method, occupy at least 70% by weight of the total particles.

2 Claims, 3 Drawing Figures

HEAT-SENSITIVE RECORDING PAPER AND FILLER THEREFOR

BACKGROUND OF THE INVENTION (1) Field of the Invention

The present invention relates to a filler for a heat-sensitive recording paper. More particularly, the present invention relates to a filler for a heat-sensitive recording paper which comprises a finely divided amorphous silicate having novel characteristics. Furthermore, the present invention relates to a heat-sensitive recording paper comprising this filler.

(2) Description of the Prior Art

A heat-sensitive recording paper comprising a support such as paper and a recording layer formed thereon, which comprises a dispersion of a coloring agent such as a leuco dye and a color developer capable of forming a color on contact with the coloring agent in the hot state, such as a phenol, in a binder has been widely used for facsimile, printers, data communication, computer terminals, measuring devices, passometers, copying machines and the like while using a thermal head, a hot pen, an infrared ray lamp, a laser or the like as a heat source.

A heat-sensitive recording paper of this type is defective in that when recording is carried out by bringing a recording layer into contact with a recording head or the like, the components contained in the recording layer are fused and adhere to the recording head or the like to cause such troubles as scum adhesion and sticking.

Various fillers have been incorporated into recording layers so as to eliminate this disadvantage. Namely, it has been known from old that calcium carbonate, kaolin, talc, alumina and titanium dioxide are incorporated. Recently, incorporation of a hydrous aluminum silicate mineral (Japanese Patent Application Laid-Open Specification No. 72992/81), amorphous synthetic aluminum silicate (Japanese Patent Publication No. 19035/82), wollastonite or calcium silicate (Japanese Patent Application Laid-Open Specification No. 41995/82), an alkaline earth metal salt (Japanese Patent Application Laid-Open Specification No. 80095/82) and aluminum hydroxide (Japanese Patent Application Laid-Open Specification No. 14093/82) has been proposed.

When these inorganic fillers are used for heat-sensitive recording papers, various limitations are imposed on the properties thereof. In the first place, in order to prevent the adhesion of scum, the filler used should have a certain oil absorption, that is, a large bulk. The second problem is how to prevent the background coloration (background contamination or back ground fogging) of the recording layer. In the case of a filler having a relatively large surface activity, the recording layer is colored in an inherent hue before the recording and a clear image cannot be obtained. Furthermore, the background is colored during the storage after the recording, and the storability or life of a print is degraded. In the third place, when a filler is incorporated into the recording layer, it should show an excellent abrasion resistance. For example, the filler should not inhibit a smooth relative movement between a recording head and a recording paper or should not abrade the recording head or recording layer.

Conventional fillers for heat-sensitive recording layers fail to simultaneously satisfy all of these requirements. For example, a filler having a large oil absorption generally has a large surface activity and the background coloration is readily caused.

SUMMARY OF THE INVENTION

It is therefore a primary object of the present invention to provide an amorphous silicate type filler for a heat-sensitive recording paper in which the background coloration is controlled and which is excellent in the lubricating property and scum adhesion-preventing property and also provide a heat-sensitive recording paper comprising this filler.

Another object of the present invention is to provide an amorphous silicate type filler for a heat-sensitive recording paper which is excellent in the whiteness of the background while the background coloration is prominently controlled and which can form a high-density image at the thermal recording step.

More specifically, in accordance with the present invention, there is provided a filler for a heat-sensitive recording layer, which comprises an amorphous silicate having a composition represented by the following oxide molecular ratio:

$$MO:SiO_2=0.01:1 \text{ to } 1.1:1$$

wherein M stands for at least one member selected from the group consisting of calcium, barium and zinc, or a product obtained by partially neutralizing said silicate with carbonic acid, said filler having a BET specific surface area of 10 to 70 $m^2/g$ and a bulk density of 0.14 to 0.30 g/cc and also having such a secondary particle size distribution that secondary particles having a size smaller han 4 $\mu$m, as determined by the centrifugal precipitation method, occupy at least 70% by weight of the total particles.

DETAILED DESCRIPTION OF THE PREFERRED EMBODIMENTS

Figure 1:
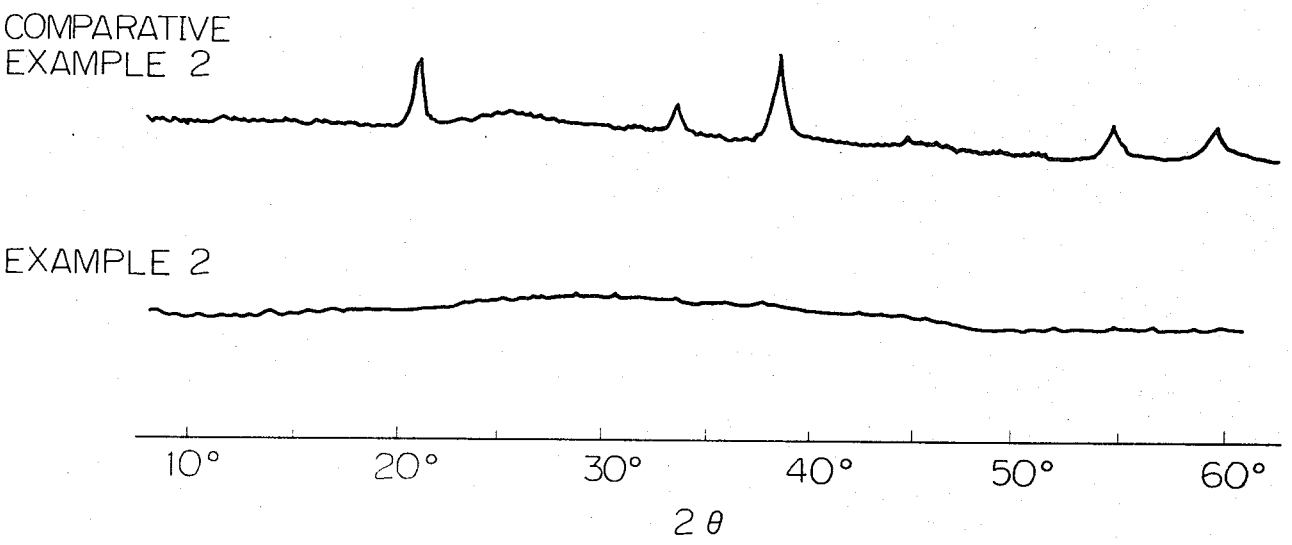
FIG. 1 show X-ray diffraction patterns of an amorphous silicate (Example 2) used in the present invention and a mixture of amorphous silica and calcium hydroxide (Comparative Example 2).

As is apparent from the detailed description given hereinafter, the present invention is based on the novel finding that when an alkali metal silicate and a corresponding metal salt are subjected to double composition in a concentrated salt solution or when an alkali metal silicate is reacted with an acid in a concentrated aqueous solution and the formed amorphous silica is treated and reacted with a corresponding metal hydroxide, a finely divided amorphous silicate having the above-mentioned characteristics is obtained, and that if this silicate is used as a filler for a heat-sensitive recording paper (sometimes referred to as "heat-sensitive paper"), various advantages, such as prevention of the background coloration, prevention of the adhesion of scum, improvement of the lubricating property and improvement of the image density, can be attained.

The amorphous silicate used in the present invention is characterized in that the BET specific surface area is relatively small, that is, 10 to 70 $m^2/g$, preferably 20 to 60 $m^2/g$, especially preferably 30 to 50 $m^2/g$. As pointed out hereinafter, the amorphous silicate is essentially surface-active and generally has a tendency to promote the reaction between a leuco dye and a phenol. According to the present invention, by controlling the specific surface area of the amorphous silicate to the above-mentioned low level and greatly reducing the surface activity, the reaction between a phenol and a leuco dye can be controlled to a low level at the step of preparing a composition for a heat-sensitive recording layer and the step of coating and drying this composition or during the storage of a recording paper before and after the recording, and therefore, the background coloration (background contamination or background fogging) is prominently controlled.

Among amorphous silicates by the wet method, one having such a small specific surface area is very peculiar and this amorphous silicate can be prepared by directly precipitating fine particles of a silicate gel without forming silicate sol particles when an alkali metal silicate is reacted with a metal salt or an acid.

Since the amorphous silicate used in the present invention has a small specific surface area as mentioned above and is prepared through the peculiar preparation process, it has a relatively large number average of primary particle size, that is, at least 30 millimicrons, especially 40 to 90 millimicrons, as measured by an electron microscope. It is known that the following relationship is generally established between the BET specific surface area ($m^2/g$) and the primary pariicle size (millimicrons):

$$SA = \frac{2700}{D}$$

wherein SA stands for the BET specific surface area and D stands for the primary particle size. Thus, it will readily be understood that the primary particle size of the amorphous silicate used in the present invention is considerably larger than that of the known amorphous silicate.

Another prominent characteristic feature of the amorphous silicate used in the present invention is that the bulk density is 0.14 to 0.30 g/cc, especially 0.16 to 0.26 g/cc, as measured according to the method of JIS K-6220. The bulk density has relations to both the prevention of the adhesion of scum to the recording head or the like and the wearing or the wearability of the recording layer. If the bulk density is too large and exceeds the above-mentioned range, the oil absorption of the amorphous silicate is reduced and therefore, the effect of preventing the adhesion of scum is reduced and the recording head or the like falling in contact with the recording layer is readily worn away. On the other hand, when the bulk density is too small and below the above-mentioned range, the wearing of the recording layer per se is increased, and dusting or peeling is readily caused. In contrast, according to the present invention, by controlling the bulk density within the above-mentioned range, wearing of the recording layer, the recording head or the like can be minimized while preventing the adhesion of scum to the recording head or the like.

Since the amorphous silicate of the present invention has the above-mentioned bulk density, the oil absorption of this silicate is in the range of from 100 to 200 cc/100 g, especially from 120 to 180 cc/100 g, as measured by the method of JIS K-5101.

The amorphous silicate used in the present invention has such a secondary particle size distribution that the secondary particles having a size smaller than 4 $\mu$m occupy at least 70% by weight of the total particles, and it is especially preferred that the median diameter of the secondary particles be in the range of from 0.2 to 2 $\mu$m. As pointed out hereinbefore, the primary particle size of this amorphous silicate is considerably large, but the degree of agglomeration is low and the secondary particles are very fine and relatively uniform in the size.

The secondary particle size of the amorphous silicate has influences on the density of an image formed by thermal recording, and as shown in the examples given hereinafter, the finer is the secondary particle size, the higher is the density of an image formed by recording. It is said that if a coloring dye formed at the thermal recording is present around the filler particles in the form covering the filler particles, the density is improved by the pigment effect. Since the amorphous silicate used in the present invention is fine and uniform in the dispersion particle size in the recording layer, that is, the secondary particle size, it is considered that the coloring dye is likely to be present in the form covering the filler and the image density is improved.

The filler of the present invention comprises amorphous calcium silicate, barium silicate, zinc silicate or a mixture thereof. Calcium silicate represented by wollastonite, which has heretofore been used as a filler for a heat-sensitive paper, is crystalline, and the silicate used in the present invention is characteristic over this known filler in the point where the silicate is amorphous. The amorphous silicate used in the present invention is in common with amorphous silica obtained by reacting an alkali metal silicate with an acid in a concentrated salt solution in various properties. However, when this amorphous silica is used as a filler for a heat-sensitive paper, the background coloration is caused to some extent. The present invention succeeds in prominently controlling the background coloration by converting this amorphous silica to a silicate of calcium, barium or zinc.

The reason why the amorphous silicate of the present invention prominently prevents the background coloration while improving the image density at the thermal recording has not completely been elucidated, but it is believed that the reason may be as follows.

In the present invention, prevention of the adhesion of scum, improvement of the lubricating property, prevention of the background coloration and improvement of the density of the recorded image depends in principle on the above-mentioned characteristics of the amorphous silicate. However, although amorphous silica satisfies all the requirements of these characteristics, it is considered that because of local surface active points, the background coloration is caused to a degree that cannot be neglected. In contrast, in the present invention, it is considered that if silicic acid is reacted with the calcium component or the like at the time of precipitation or after formation of the precipitate, these active points are effectively prevented from remaining on the surfaces of filler particles, with the result that the background coloration is effectively prevented.

In the present invention, it is important that the metal component in the silicate should be calcium, barium or zinc. For example, if magnesium silicate, which is a silicate of another metal of the Group II of the Periodic Table, is used, the density of the background coloration is rather increased.

It also is important that the metal component such as calcium should be contained in an amount of 1 to 50% by weight, especially 5 to 30% by weight, on the oxide base in the silicate. If the amount of the metal oxide is smaller than 1% by weight, the background coloration-preventing effect is considerably degraded, and if the amount of the metal oxide is larger then 50% by weight, the dispersibility of the amorphous silicate in the coating composition for formation of a heat-sensitive recording layer is considerably degraded.

Figure 2:
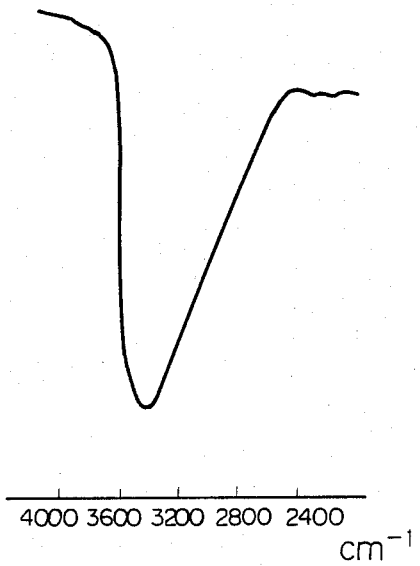
FIG. 2 shows an infrared absorption spectrum of the above-mentioned amorphous silicate (Example 2).
Figure 3:
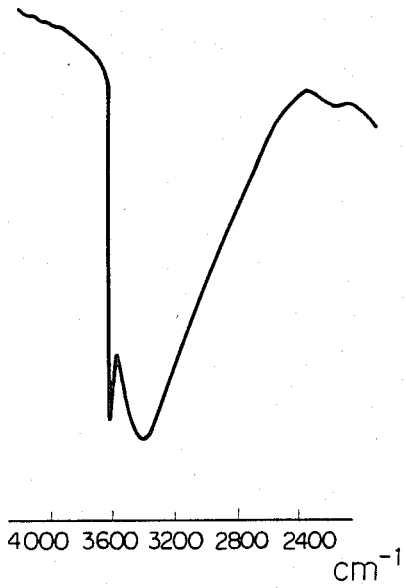
FIG. 3 shows an infrared absorption spectrum of the above-mentioned mixture (Comparative Example 2).

From the X-ray diffractometric viewpoint, the amorphous silicate used in the present invention should naturally be amorphous, and it shows a characteristic infrared absorption spectrum. FIG. 1 of the accompanying drawings shows X-ray diffraction patterns, as determined at a reflection angle ($2\theta$) of 10° to 60°, of the amorphous silicate (Example 2) used in the present invention and a mixture of amorphous silicic acid and calcium hydroxide (Comparative Example 2). FIGS. 2 and 3 show infrared absorption spectra, as determined at 4000 to 2400 $cm^{-1}$, of the above-mentioned silicate (Example 2) and the above-mentioned mixture, respectively. From these infrared absorption spectra, it is seen that the amorphous silicate of the present invention has no characteristic absorption based on the metal hydroxide at a wave number of 3550 to 3650 $cm^{-1}$ but has a prominent characteristic absorption based on the silanolic hydroxyl group and/or water of adsorption at a wave number of 3300 to 3500 $cm^{-1}$. Furthermore, this amorphous silicate ordinarily has an ignition loss of 4 to 16% by weight (1000° C. ×2 hours) due to removal of the silanolic hydroxyl group and/or water of adsorption. Since this amorphous silicate is prepared in a concentrated salt solution, it contains a minute amount of this salt as an impurity.

Since the finely divided amorphous silicate used in the present invention has the above-mentioned particle structure and characteristics, if it is used as a filler for a heat-sensitive recording paper, several additional advantages are attained. When this silicate is rubbed between fingers, it gives a smooth touch like that of talc, and when it is brought into sliding contact with a surface, it is well extended and spread along the sliding contact surface. In fact, the coated surface containing this finely divided silicate has an excellent slip property and the blocking tendency is drastically reduced, and therefore, feeding of respective recording sheets from the assembly of piled sheets can be performed very smoothly and the running property of the recording head or pen is prominently improved. Furthermore, when this finely divided silicate is coated on a paper substrate or the like, it is uniformly extended and spread on the entire coated surface. Because of this characteristic, the surface coated with the finely divided silicate of the present invention is excellent in the smoothness over the surface coated with other silica or silicate type filler. Moreover, this finely divided silicate has a higher hiding power than the known finely divided silica or silicate. Accordingly, this silicate exerts an effect of hiding the testure or color of the coated surface and whitening the coated surface.

The finely divided amorphous silicate used in the present invention is prepared according to the two-stage process in which an alkali metal silicate is reacted with an acid in a concentrated metal salt solution under such conditions that fine gel particles of silica are directly precipitated without formation of a sol of silica and the formed fine silica gel particles are reacted with a corresponding metal hydroxide in the presence of water, or a one-stage process (direct process) in which an alkali metal silicate and a corresponding metal salt are subjected to double decomposition in a concentrated salt solution under such conditions that fine silicate gel particles are directly precipitated without formation of a sol of the silicate. Of course, the process for the preparation of the amorphous silicate used in the present invention is not limited to the above-mentioned two processes.

This two-stage preparation process is in common with the conventional process for preparing silica by the wet method in the point where a solution of an alkali metal silicate is neutralized with an acid, but this process is characterized in that this neutralization is carried out in a concentrated metal salt solution especially by the simultaneous pouring method and a gel of fine particles of silica is directly formed by this neutralization without formation of sol particles of silica.

According to the conventional process for preparing silica by the wet method, an acid is added to an aqueous solution of an alkali metal silicate to form amorphous silica. When this reaction is observed, it is seen that at the initial stage of the addition, the reaction mixture is transparent or pearly but the reaction mixture becomes viscous and at the middle stage of the addition, precipitation of silica begins. This fact indicates that according to the wet method, sol particles of silica are once formed by neutralization and the sol particles are agglomerated to form amorphous silica particles. Furthermore, silica particles formed by neutralization are alkaline at the initial stage and they gradually become acidic with advance of neutralization, and properties of the amorphous silica precipitate formed at the initial stage are considerably different from those of the amorphous silica precipitate formed at the middle stage of the reaction.

In contrast, in the preparation process of the present invention, since the neutralization of the aqueous solution of the alkali metal silicate with the acid is carried out in a concentrated metal salt solution, by strong coagulating and precipitating actions of the salt, a gel of fine particles of silica is directly formed without passing through sol particles of silica. By dint of this characteristic of the preparation process, the finely divided silica used as the starting material in the present invention is composed of primary particles having a size of at least 30 millimicrons, especially 40 to 90 millimicrons, though conventional silica by the wet method is an agglomerate of sol particles having a particle size of 10 to 20 millimicrons. Furthermore, since gel particles are formed under the above-mentioned coagulating and precipitating actions of the salt, this finely divided amorphous silica has a specific surface area of 10 to 70 $m^2/g$, which is much smaller than the specific surface area of conventional amorphous silica.

Moreover, according to this preparation process, since the simultaneous pouring method is adopted, neutralization is carried out at a constant pH value of 5 to 9 throughout the reaction from the initial stage to the final stage, and the properties, especially the particle size, of formed amorphous silica are uniform. This is another advantage attained by the above preparation process.

It is important that the concentrated aqueous solution of the metal salt should have a high concentration from the initial stage of addition of the alkali metal silicate or acid. Although an alkali metal salt should naturally be formed by the reaction between the alkali metal silicate and acid, if the alkali metal salt is not contained at a high concentration in the reaction system at the start of the reaction, formed amorphous silica has a fine primary particle size but a coarse secondary particle size, and the specific surface area tends to increase.

The concentration of the metal salt is at least 5%, especially 10 to 20%, at the start of the neutralization reaction, though the preferred concentration differs according to the kind of the metal salt. If the salt concentration is lower than 5%, the secondary particle size or specific surface area tends to increase beyond the range specified in the present invention, and even if the concentration is too high, no particular advantage is brought about but the process becomes economically disadvantageous.

Alkali metal and alkaline earth metal salts of inorganic acids and organic acids can be used as the metal salt. For example, there can be mentioned sodium chloride, sodium nitrate, sodium sulfate, sodium sulfite, sodum carbonate, sodium phosphate, potassium chloride, sodium acetate, sodium methane-sulfonate, calcium chloride, magnesium chloride and magnesium sulfate. These metal salts may be used singly or in the form of a mixture of two or more of them. In the case of a salt of a monobasic acid, the allowable range of the salt concentration for obtaining silica having the above-mentioned properties is wide, but in the case of a salt of a dibasic acid, this allowable range of the salt concentration is relatively narrow. As the salt advantageous from the economical viewpoint and suitable for attaining the objects of the present invention, there can be mentioned sodium chloride, Glauber salt and a mixture thereof.

An aqueous solution of an optional alkali metal silicate, for example, an alkali metal silicate represented by the following formula:

$$M_2O \cdot nSiO_2$$

wherein M stands for an alkali metal and n is a number of from 1 to 3.8, can be used as the alkali metal silicate. From the economical viewpoint, it is preferred that so-called sodium silicate No. 3 in which n is in the range of from 3.0 to 3.4 be used. The concentration of the alkali metal silicate used for the reaction is not particularly critical, but from the viewpoint of the adaptability to the operation, it is preferred that the concentration of the alkali metal silicate be 10 to 25% as $SiO_2$.

Various inorganic acids and organic acids may be used as the acid. From the economical viewpoint, it is preferred that a mineral acid such as sulfuric acid, hydrochloric acid, nitric acid or phosphoric acid be used. In order to carry out the reaction uniformly, it is preferred that the acid be used in the form of a dilute aqueous solution having a concentration of 5 to 20%.

The neutralization reaction may be carried out at room temperature or under heating, but is is ordinarily preferred that the reaction be promptly advanced at an elevated temperature of 50° to 100° C. When the alkali metal silicate and acid are simultaneously poured into the concentrated aqueous solution of the metal salt to effect the neutralization reaction, it is important that the three components should be mixed promptly and homogeneously. Accordingly, simultaneous pouring is carried out under high speed agitation or shearing agitation. This reaction may be carried out batchwise or in a continuous manner. In the former case, for example the concentrated salt solution is charged into a reaction vessel and both the starting materials are simultaneously poured into the reaction vessel, or the concentrated salt solution is circulated between a reaction vessel and a preliminary mixing tank and both the starting materials are simultaneously poured into the preliminary mixing tank. In the latter case, the reaction is carried out in a continuous manner by using a multistage reaction vessel or column type reaction vessel.

In preparing amorphous silica, it is preferred that the neutralization reaction be carried out so that the $SiO_2$ concentration in the slurry at the time of termination of the reaction is 1 to 10%. If this concentration is lower than 1%, the process becomes disadvantages in the operation or apparatus and if the concentration is higher than 10%, the secondary particles tend to become coarse. Precipitation of finely divided amorphous silica is completed in a very short time by the above-mentioned simultaneous pouring and mixing, but in some cases, it is preferred that aging be conducted for about 30 minutes to about 10 hours after the precipitation.

The slurry formed by the reaction is subjected to solid-liquid separation such as filtration to separate amorphous silica from the mother liquor, and if necessary, the separated silica is washed with water, and is reacted with a corresponding metal hydroxide. As the metal hydroxide, there are used calcium hydroxide, barium hydroxide and zinc hydroxide. For example, calcium hydroxide may be supplied to the reaction system in the form of lime milk. Moreover, there may be adopted a method in which an aqueous suspension of an oxide is supplied to the reaction system and the reaction is then effected.

This reaction of the second stage may be carried out at room temperature or under heating. From the viewpoint of the easiness of the reaction, it is preferred that the reaction be carried out at a temperature of 50° to 100° C. which is equal to or higher than the silica gel-forming temperature. The amount used of the hydroxide is determined so that a desirable amount of the metal oxide is included in the silicate. The termination of the reaction is confirmed by disappearance of the characteristic absorption of the hydroxyl group of the metal hydroxide in the infrared absorption spectrum and/or disappearance of the diffraction pattern of the metal hydroxide and/or oxide in the X-ray diffraction pattern. The reaction time is ordinarily in the range of from 0.5 to 5 hours, though the reaction time varies according to the temperature or the amount of the metal hydroxide.

The formed silicate is recovered by solid-liquid separation, washed with water and dried to obtain a product.

According to the one-stage process, a solution of a metal salt such as calcium chloride, calcium nitrate, barium chloride, barium nitrate, zinc chloride or zinc sulfate is used instead of the acid used at the above-mentioned step of preparing silica gel, and this salt solution and an aqueous solution of an alkali metal silicate are simultaneously poured into a concentrated salt solution to effect double decomposition. Other procedures are the same as in the above-mentioned process for the preparation of silica gel.

In this double decomposition process, the adjustment of the amount of the metal oxide included in the silicate can easily be accomplished, for example, by using a solution of a mixture of the above-mentioned metal salt and acid as the solution to be poured simultaneously with the alkali metal silicate solution and adjusting the ratio of both. Namely, if the ratio of the metal salt is increased, the ratio of the metal oxide in the silicate is increased, and if the ratio of the metal salt is decreased, the ratio of the metal oxide in the silicate is reduced. In this one-stage process, since the double decomposition reaction is utilized, the pH value of the reaction system is ordinarily higher than in the silica gel-forming reaction and is in the range of from 6 to 11.

The amorphous silicate particles prepared according to the above-mentioned one-stage or two-stage process may directly be used as a filler for a heat-sensitive paper. Furthermore, there may be adopted a method in which carbon dioxide gas is blown into an aqueous slurry of the amorphous silicate particles to partially neutralize the amorphous silicate particles so that the pH value of the aqueous slurry is in the range of from 7 to 9, and the so-formed partially neutralized product may be used as a filler.

In accordance with another embodiment of the present invention, there is provided a heat-sensitive recording paper comprising a paper substrate and a heat-sensitive recording layer formed on the paper substrate, which comprises a composition formed by dispersing in a binder a coloring agent composed of a leuco dye, a color developer composed of a heat-fusible phenol and an inorganic filler, wherein said inorganic filler is an amorphous silicate having a composition represented by the following oxide molecular ratio:

$$MO:SiO_2=0.01:1 \text{ to } 1.1:1$$

wherein M stands for at least one member selected from the group consisting of calcium, barium and zinc, or a product obtained by partially neutralizing said silicate with carbonic acid, said filler having a BET specific surface area of 10 to 70 $m^2/g$ and a bulk density of 0.14 to 0.30 g/cc and also having such a secondary particle size distribution that secondary particles having a size smaller than 4 $\mu$m, as determined by the centrifugal precipitation method, occupy at least 70% by weight of the total particles.

The amorphous silicate filler of the present invention may be incorporated into the above-mentioned known heat-sensitive recording layer-forming composition in an amount of 10 to 60% by weight, especially 20 to 40% by weight, based on the solids.

As the leuco dye incorporated as the coloring agent in the above composition, there can be used all of leuco dyes used for heat-sensitive recording papers of this type, such as triphenylmethane type leuco dyes, fluorane type leuco dyes, spiropyran type leuco dyes, Rhodamine lactam type leuco dyes, Auramine type leuco dyes and phenothiazine type leuco dyes. These leuco dyes may be used singly or in the form of mixtures of two or more of them.

As the phenol used as the color developer, there can be used all of phenols that are solid at normal temperatures and are heat-fusible, such as bisphenol A, bisphenol F, 2,6-dihydroxybenzoic acid and benzyl-p-hydroxybenzoate.

An optional water-soluble binder can be used as the binder. For example, there can be mentioned starch, cyanomethylated starch, carboxymethylated starch, ethyl cellulose, carboxymethyl cellulose, hydroxyethyl cellulose, polyvinyl alcohol, a water-soluble acrylic resin, a vinyl methyl ether copolymer and sodium alginate.

A sensitizer may be incorporated into the above composition according to need. For example, various waxes such as fatty acids, fatty acid amides, carnauba wax and polyethylene wax may be used as the sensitizer. Furthermore, an organic base such as an alkanol amine may be incorporated so as to prevent the background coloration.

For formation of the heat-sensitive recording layer, a dispersion of a leuco dye in a binder solution and a dispersion of a phenol in a binder solution are prepared, and both the dispersions are coated on a substrate such as paper or artificial paper. The amorphous silica filler of the present invention may be incorporated in the dispersion of the phenol in advance, or a dispersion of the amorphous silicate filler in a binder solution is separately prepared and then mixed with the dispersions of the leuco dye and the phenol, and the resulting mixed dispersion is used for formation of the recording layer.

The present invention will now be described in detail with reference to the following examples that by no means limit the scope of the invention.

COMPARATIVE EXAMPLE 1

According to the process disclosed in Japanese Patent Application No. 132201/82, in 17.8 l of a 15% solution of lithium chloride heated at 85° C., 3.6 l of a solution of sodium silicate No. 3 (about 7% of $Na_2O$ and about 22% of $SiO_2$) and about 3.6 l of 10% hydrochloric acid were simultaneously poured over a period of 60 minutes so that the pH value of the reaction liquid was maintained at 6 to 8. The formed precipitate was recovered by filtration and washed with 30 l of warm water. The obtained cake was dried in a drier maintained at 130° C. and pulverized by a desk sample mill (Model TAMS-1 supplied by Tokyo Atomizer) to obtain finely divided silica having properties shown in Table 1.

Then, 1 part of the so-obtained finely divided silica was mixed into 2 parts of a liquid (A), 10 parts of a liquid (B) and 6 parts of a liquid (C), each being a heat-sensitive recording layer-forming liquid having a composition shown below and being pulverized and dispersed by a ball mill for 48 hours previously.

| | |
|---|---|
| Composition of Liquid (A): | |
| Crystal Violet Lactone | 1 part by weight |
| 5% Hydroxyethyl Cellulose | 5 parts by weight |
| Water | 3 parts by weight |
| Composition of Liquid (B): | |
| Bisphenol A | 1 part by weight |
| 5% Hydroxyethyl Cellulose | 5 parts by weight |
| Water | 3 parts by weight |
| Composition of Liquid (C): | |
| Stearic Acid Amide | 1 part by weight |
| 5% Hydroxyethyl Cellulose | 5 parts by weight |
| Water | 3 parts by weight |

The resulting heat-sensitive recording layer-forming liquid was coated on a commercially available woodfree paper having a basis weight of 64 b/$m^2$ so that the weight of the coating on the dry basis was 6 to 7 g/$m^2$, and the coating was dried at room temperature.

The so-obtained heat-sensitive recording paper was evaluated with respect to (a) the background coloration density, (b) the density of the colored image formed by heating and (c) the heat-sensitive recording layer-retaining property according to methods described below. The obtained results are shown in Table 1.

(a) Background Coloration Density

When 72 hours had passed after the coating operation, the background coloration density of the coated paper having the heat-sensitive recording layer was measured by a standard densitometer (Model FSD-103 supplied by Fuji Photo-Film Co.) using a V-filter, and simultaneously, the naked eye observation was carried out. The evaluation standard is as follows.

| Symbol | Criterion of Evaluation | Background Coloration Density |
|---|---|---|
| | no background coloration and high whiteness | below 0.13 |
| | no substantial background coloration | 0.13 to 0.20 |
| | slight background coloration was observed but paper was practically applicable | 0.20 to 0.30 |
| X | prominent background coloration was observed and paper was not practically applicable | above 0.30 |

(b) Density of Colored Image Formed by Heating

In order to evaluate the coloring property of the heat-sensitive recording paper, the back surface of the coated paper was pressed for 5 seconds by a thermal plate set at 155° C., and the density of the colored image formed by heating was measured by a standard densitometer (Model FSD-103). Simultaneously, the naked eye observation was carried out. The evaluation standard is as follows.

| Symbol | Criterion of Evaluation | Image Density |
|---|---|---|
| | clear image having high density was obtained | above 1.2 |
| | practical image density was obtained | 1.1 to 1.2 |
| X | image density was low and paper could not practically be used | below 1.1 |

(c) Heat-Sensitive Recording Layer-Retaining Property

Filter paper No. 2 for the qualitative analysis was placed below the coated paper having the heat-sensitive recording layer and the coated surface of the coated paper was superposed on the filter paper, and a thermal plate set at 155° C. was pressed for 1 minute to the assembly from the back side of the coated surface and the state of the adhesion of the components of the recording layer, which had migrated onto the filter paper, was examined. Furthermore, the adhesion of scum to the thermal head was examined by using a heat-sensitive facscimile device (Model Hifax-3000). The heat-sensitive recording layer-retaining property was generally evaluated according to the following standard.

| Symbol | Criterion of Evaluation |
|---|---|
| | no substantial adhesion was observed |
| | slight adhesion was observed but paper was practically applicable |
| X | considerable adhesion was observed and paper was not practically applicable |

In the Examples and Comparative Examples, the physical properties of powders were determined according to the following methods.

(1) BET Specific Surface Area (SA)

The specific surface area of each powder was determined according to the so-called BET method utilizing the adsorption of nitrogen gas. This method is described in detail in S. Brunauer, P. H. Emmet and E. Teller, J. Am. Chem. Soc., 60, 309 (1938).

The specific surface area referred to in the instant specification was measured in the following manner. The sample dried to 150° C. was charged in an amount of 0.5 to 0.6 g into a weighing bottle, dried for 1 hour in a thermostat drier maintained at 150° C. and precisely weighed. The sample was charged in an adsorption test tube and heated at 200° C., and evacuation was carried out until the vacuum degree in the adsorption test tube reached $10^{-4}$ mmHg. The test tube was naturally cooled and placed in liquefied nitrogen at about −196° C. At 4 to 5 points in the range of $pN_2/po = 0.05$ to 0.30 ($pN_2$ stands for the nitrogen gas pressure and po stands for the atmospheric pressure at the time of the measurement), the amount adsorbed of $N_2$ gas was measured. The amount adsorbed of $N_2$ gas, from which the dead volume was subtracted, was converted to the amount adsorbed at 0° C. under 1 atmosphere and then substituted into the BET equation to determine Vm (cc/g) (which stands for the amount adsorbed of nitrogen gas necessary for forming a monomolecular layer on the surface of the sample). The specific surface area SA ($m^2/g$) was calculated by the formula of $SA = 4.35 \times Vm$.

(2) Bulk Density(Apparent Specific Gravity)

The bulk density was measured by the iron cylinder method described in the rubber additive test of JIS K-6220. The amount of the sample used for the test was 1 g.

(3) Oil Absorption

The oil absorption was measured by the pigment test method of JIS K-5101. The amount of the sample used for the test was 0.5 g.

(4) Secondary Particle Size and Particle Size Distribution

The determination was carried out by using Micron-Photo-Sizer SKN-1000 (supplied by Seishin Kigyo) in which the principle of the centrifugal precipitation method was adopted. The sample was dispersed for 5 minutes by using an ultrasonic dispersing machine (SK-DISPERSER supplied by Seishin Kigyo). From the obtained particle size distribution, the cumulative weight percent of secondary particles having a size smaller than 4 microns and the median size of the secondary particles (50% cumulation point) were determined.

(5) Primary Particle Size

A Photo taken at 5000 to 20,000 magnifications by an electron microscope (Model JEM-T6S supplied by Nippon Denshi) was enlarged at a ratio of 50,000 to 200,000, and the sizes of more than 1000 particles in a certain direction were measured and the arithmetic mean size was calculated.

(6) X-Ray Diffraction

The X-ray diffraction was conducted by using an X-ray diffraction apparatus (Geigerflex Model 2028 supplied by Rigaku Denki) under the following conditions.
Target: Cu
Filter: Ni
Voltage: 35 KV
Current: 15 mA
Count full scale: 8,000 c/s
Time constant: 1 sec
Scanning speed: 2°/min
Chart speed: 2 cm/min
Diffraction angle: 1°
Slit width: 0.3 mm (7) Infrared Absorption The test was carried out by using an infrared spectrophotometer (Model A-302 supplied by Nippon Bunko Kogyo) under the following conditions.
Sampling method: KBr tablet method
Concentration: 2 mg/100 mg KBr
Scanning speed: 5000 $cm^{-1}$/8 min→330 $cm^{-1}$/8 min.

EXAMPLE 1

In 9.8 l of a 15% solution of sodium chloride heated at 85° C., 3.6 l of a solution of sodium silicate No. 3 (about 7% of $Na_2O$ and about 22% of $SiO_2$) and 3.6 l of a mixed solution of 23% hydrochloric acid-2.9% calcium chloride were simultaneously poured over a period of 60 minutes so that the pH value of the reaction liquid was maintained at 8 to 10. The formed precipitate was recovered by filtration and washed with 30 l of warm water.

The so-obtained cake was dried in a drier maintained at 130° C. and pulverized by a desk sample mill (Model TAMS-1 supplied by Tokyo Atomizer) to obtain a finely divided filler having properties shown in Table 1.

In the same manner as described in Comparative Example 1, a heat-sensitive recording paper was prepared by using the so-obtained finely divided filler. The background coloration density, the density of the colored image formed by heating and the heat-sensitive recording layer-retaining property were measured and evaluated in the same manner as described in Comparative Example 1.

The obtained results are shown in Table 1.

EXAMPLE 2

In 12.8 l of a 10% solution of calcium chloride heated at 85° C., 3.6 l of a solution of sodium silicate No. 3 (about 7% of $Na_2O$ and about 22% of $SiO_2$) and about 3.6 l of a mixed solution of 5.2% hydrochloric acid-5.9% calcium chloride were simultaneously poured over a period of 60 minutes so that the pH value of the reaction liquid was maintained at 9 to 11. The formed precipitate was recovered by filtration and washed with 30 l of warm water. The obtained cake was dried in a drier maintained at 130° C. and pulverized by a desk sample mill (Model TAMS-1 supplied by Tokyo Atomizer) to obtain a finely divided filler having properties shown in Table 1.

In the same manner as described in Comparative Example 1, a heat-sensitive recording paper was prepared by using the so-obtained finely divided filler. The background coloration density, the density of the colored image formed by heating and the heat-sensitive recording layer-retaining property were measured and evaluated in the same manner as described in Comparative Example 1.

The obtained results are shown in Table 1.

EXAMPLE 3

In 12.6 l of a 10% solution of sodium nitrate heated at 85° C., 3.7 l of a solution of sodium silicate No. 1(about 11% of $Na_2O$ and about 22% of $SiO_2$) and 3.7 l of a mixed solution of 5.1% barium nitrate-32% nitric acid were simultaneously poured over a period of 60 minutes so that the pH value of the reaction liquid was maintained at 9 to 11. The formed precipitate was recovered by filtration and washed with 30 l of warm water.

The obtained cake was dried in a drier maintained at 130° C. and pulverized by a desk sample mill (Model TAMS-1 supplied by Tokyo Atomizer) to obtain a finely divided filler having properties shown in Table 1.

In the same manner as described in Comparative Example 1, a heat-sensitive recording paper was prepared by using the so-obtained finely divided filler. The background coloration density, the density of the colored image formed by heating and the heat-sensitive recording layer-retaining property were measured and evaluated in the same manner as described in Comparative Example 1.

The obtained results are shown in Table 1.

EXAMPLE 4

In 12.8 l of a 10 % solution of sodium chloride heated at 85° C., 3.6 l of a solution of sodium silicate No. 3 (about 7% of $Na_2O$ and about 22% of $SiO_2$) and about 3.6 l of a mixture of 13% hydrochloric acid-9.5% zinc chloride were simultaneously poured over a period of 60 minutes so that the pH value of the reaction liquid was maintained at 6.5 to 8. The formed precipitate was recovered by filtration and washed with 30 l of warm water.

The obtained cake was dried in a drier maintained at 130° C. and pulverized by a desk sample mill (Model TAMS-1 supplied by Tokyo Atomizer) to obtain a finely divided filler having properties shown in Table 1.

In the same manner as described in Comparative Example 1, a heat-sensitive recording paper was prepared by using the so-obtained finely divided filler. The background coloration density, the density of the colored image formed by heating and the heat-sensitive recording layer-retaining property were measured and evaluated in the same manner as described in Comparative Example 1.

The obtained results are shown in Table 1.

EXAMPLE 5

In 1.94 l of water was sufficiently dispersed 1.06 Kg of the washed cake obtained in Comparative Example 1 (the water content was 83%) by using a stirrer. Then, 0.13 l of lime milk (15 g of CaO per 100 ml) was added to the dispersion and the mixture was heated at 85° C. for 2 hours with stirring. The formed precipitate was recovered by filtration, and the obtained cake was dried in a drier maintained at 130° C. and pulverized by a desk sample mill (Model TAMS-1 supplied by Tokyo Atomizer) to obtain a finely divided filler having properties shown in Table 1.

In the same manner as described in Comparative Example 1, a heat-sensitive recording paper was prepared by using the so-obtained finely divided filler. The background coloration density, the density of the colored image formed by heating and the heat-sensitive recording layer-retaining property were measured and evaluated in the same manner as described in Comparative Example 1.

The obtained results are shown in Table 1.

EXAMPLE 6

In 2.35 l of water was sufficiently dispersed 0.65 Kg of the washed silica cake obtained in Comparative Example 1 (the water content was 83%) by using a stirrer. Then, 0.6 l of lime milk (15 g of CaO per 100 ml) was added to the dispersion and the mixture was heated at 85° C. for 5 hours with stirring. The formed precipitate was recovered by filtration and the obtained cake was dried in a drier maintained at 130° C. and pulverized by a desk sample mill (Model TAMS-1 supplied by Tokyo Atomizer) to obtain a finely divided filler having properties shown in Table 1.

In the same manner as described in Comparative Example 1, a heat-sensitive recording paper was prepared by using the so-obtained finely divided filler. The background coloration density, the density of the colored image formed by heating and the heat-sensitive recording layer-retaining property were measured and evaluated in the same manner as described in Comparative Example 1.

The obtained results are shown in Table 1.

EXAMPLE 7

In 3.94 l of water was sufficiently dispersed 1.06 Kg of the washed silica cake obtained in Comparative Example 1 (the water content was 83%) by a stirrer, and 41 g of barium hydroxide octahydrate (extra pure reagent) was added to the dispersion and the mixture was heated at 85° C. for 3 hours with stirring. The formed precipitate was recovered by filtration and the obtained cake was dried in a drier maintained at 130° C. and pulversized by a desk sample mill (Model TAMS-1 supplied by Tokyo Atomizer) to obtain a finely divided filler having properties shown in Table 1.

In the same manner as described in Comparative Example 1, a heat-sensitive recording paper was prepared by using the so-obtained finely divided filler. The background coloration density, the density of the colored image formed by heating and the heat-sensitive recording layer-retaining property were measured and evaluated in the same manner as described in Comparative Example 1.

The obtained results are shown in Table 1.

EXAMPLE 8

Carbon dioxide gas of the industrial grade was blown at a flow rate of 0.5 l/min at a temperature of 20° C. into 1 liter of the reaction liquid obtained in Example 5 before the filtration unit the pH value of the reaction liquid became 8. The formed precipitate was recovered by filtration and the obtained cake was dried in a drier maintained at 130° C. and pulverized by a desk sample mill (Model TAMS-1 supplied by Tokyo Atomizer) to obtain a finely divided filler having properties shown in Table 1.

In the same manner as described in Comparative Example 1, a heat-sensitive recording paper was prepared by using the so-obtained finely divided filler. The background coloration density, the density of the colored image formed by heating and the heat-sensitive recording layer-retaining property were measured and evaluated in the same manner as described in Comparative Example 1.

The obtained results are shown in Table 1.

COMPARATIVE EXAMPLE 2

In a V-type blender, 90 g of the pulverized fine silica obtained in Comparative Example 1 was blended for 10 minutes with 13.5 g of calcium hydroxide (extra pure reagent).

In the same manner as described in Comparative Example 1, a heat-sensitive recording paper was prepared by using the so-obtained fine silica-calcium hydroxide mixture. The background coloration density, the density of the colored image formed by heating and the heat-sensitive recording layer-retaining property were measured and evaluated in the same manner as described in Comparative Example 1.

The obtained results are shown in Table 1.

COMPARATIVE EXAMPLES 3 THROUGH 6

Properties of commercially available wollastonite (Comparative Example 3), Silene ®(silicate type white carbon supplied by Harwick Std. Che., Co.) (Comparative Example 4), Silmos ®(silicate type white carbon supplied by Shiraishi Kogyo) (Comparative Example 5) and precipitated light calcium carbonate (supplied by Shiraishi Kogyo) (Comparative Example 6) are shown in Table 1.

In the same manner as described in Comparative Example 1, heat-sensitive recording papers were prepared by using these powders. With respect to each of the heat-sensitive recording papers, the background coloration density, the density of the colored image formed by heating and the heat-sensitive recording layer-retaining property were measured and evaluated in the same manner as described in Comparative Example 1.

The obtained results are shown in Table 1.

TABLE 1

| | Kind of Powder | Specific Surface Area ($m^2/g$) | Properties of Powder: Bulk Density ($g/cm^3$) | Properties of Powder: Oil Absorption (ml/100 g) | Cumulative Weight % of Particles Less Than 4μ |
|---|---|---|---|---|---|
| Comparative Example 1 | amorphous silica | 41 | 0.198 | 145 | 97.3 |
| Example 1 | amorphous silicate | 38 | 0.171 | 152 | 94.9 |
| Example 2 | " | 32 | 0.184 | 149 | 90.0 |
| Example 3 | " | 18 | 0.280 | 106 | 84.0 |
| Example 4 | " | 40 | 0.185 | 148 | 93.5 |
| Example 5 | " | 31 | 0.146 | 155 | 81.6 |
| Example 6 | " | 25 | 0.241 | 159 | 78.5 |
| Example 7 | " | 33 | 0.179 | 140 | 96.7 |
| Example 8 | " | 67 | 0.180 | 141 | 74.5 |
| Camparative Example 2 | amorphous silica-calcium hydroxide | 38 | 0.215 | 140 | 95.9 |

TABLE 1-continued

| | | | | | |
|---|---|---|---|---|---|
| | mixture | | | | |
| Comparative Example 3 | commercially available wollastonite | 1 | 0.535 | 41 | 5.2 |
| Comparative Example 4 | commercially available silicate type white carbon | 81 | 0.283 | 109 | 6.9 |
| Comparative Example 5 | commercially available silicate type white carbon | 89 | 0.269 | 115 | 26.1 |
| Comparative Example 6 | commercially available precipitated light calcium carbonate | 2 | 0.446 | 52 | 28.2 |

| | Properties of Powder | | Properties of Heat-Sensitive Paper | | | | |
|---|---|---|---|---|---|---|---|
| | Median Secondary Particle Size (μ) (50% Cumulation Size) | Mean Primary Particle Size (mμ) (Number-Average Size in Constant Direction) | Background Coloration | | Colored Image Formed by Heating | | Heat-Sensitive Recording Layer-Retaining Property Evaluation |
| | | | Evaluation | Density | Evaluation | Density | |
| Comparative Example 1 | 0.6 | 65 | ⊙ | 0.14 | ⊙ | 1.34 | ⊙ |
| Example 1 | 0.6 | 68 | ◎ | 0.10 | ⊙ | 1.39 | ⊙ |
| Example 2 | 0.6 | 79 | ◎ | 0.09 | ⊙ | 1.38 | ⊙ |
| Example 3 | 1.1 | 127 | ◎ | 0.11 | ⊙ | 1.31 | ⊙ |
| Example 4 | 0.6 | 75 | ◎ | 0.10 | ⊙ | 1.35 | ⊙ |
| Example 5 | 0.8 | 65 | ◎ | 0.10 | ⊙ | 1.38 | ⊙ |
| Example 6 | 1.0 | 96 | ◎ | 0.12 | ⊙ | 1.30 | ⊙ |
| Example 7 | 0.5 | 85 | ◎ | 0.10 | ⊙ | 1.40 | ⊙ |
| Example 8 | 1.3 | 89 | ◎ | 0.12 | ⊙ | 1.39 | ⊙ |
| Comparative Example 2 | 0.6 | 81 | X | 0.39 | ⊙ | 1.34 | ⊙ |
| Comparative Example 3 | 9.6 | 4700 | ○ | 0.23 | X | 1.07 | X |
| Comparative Example 4 | 14.0 | 28 | ○ | 0.22 | X | 1.06 | ○ |
| Comparative Example 5 | 7.8 | 70 | ○ | 0.20 | ○ | 1.12 | ○ |
| Comparative Example 6 | 7.2 | 3300 | ⊙ | 0.17 | ○ | 1.16 | X |

As is apparent from the results of the foregoing example, it will readily be understood that when the finely divided filler of the present invention is used for a heat-sensitive recording paper, the background coloration of the heat-sensitive recording layer is prominently reduced without degradation of the density of the colored image, and the effect of preventing the sticking of the paper or adhesion of scum to a thermal head is maintained at a very high level.

We claim:

1. A heat-sensitive recording paper comprising a paper substrate and a heat-sensitive recording layer formed on the paper substrate, which comprises a composition formed by dispersing in a binder a coloring agent composed of a leuco dye, a color developer composed of a heat-fusible phenol and an inorganic filler, wherein said inorganic filler is an amorphous silicate having a composition represented by the following oxide molecular ratio:

$$MO:SiO_2=0.01:1 \text{ to } 1.1:1$$

wherein M stands for at least one member selected from the group consisting of calcium, barium and zinc, or a product obtained by partially neutralizing said silicate with carbonic acid, said filler having a BET specific surface area of 10 to 70 $m^2/g$ and a bulk density of 0.14 to 0.30 g/cc and also having such a secondary particle size distribution that secondary particles having a size smaller than 4 μm, as determined by the centrifugal precipitation method, occupy at least 70% by weight of the total particles.

2. A heat-sensitive recording paper as set forth in claim 1, wherein the amorphous silicate filler is present in the composition in an amount of 10 to 60% by weight based on the solids.

* * * * *